US011806744B2

(12) United States Patent
Netuschill et al.

(10) Patent No.: US 11,806,744 B2
(45) Date of Patent: Nov. 7, 2023

(54) METHOD FOR DECORATING A MECHANICAL PART

(71) Applicant: Comadur SA, Le Locle (CH)

(72) Inventors: Alexandre Netuschill, Le Cerneux-Pequignot (CH); Fabien Bontaz, Sonvilier (CH)

(73) Assignee: Comadur SA, Le Locle (CH)

( * ) Notice: Subject to any disclaimer, the term of this patent is extended or adjusted under 35 U.S.C. 154(b) by 150 days.

(21) Appl. No.: 16/846,719

(22) Filed: Apr. 13, 2020

(65) Prior Publication Data

US 2021/0060605 A1 Mar. 4, 2021

(30) Foreign Application Priority Data

Aug. 27, 2019 (EP) ..... 19193878

(51) Int. Cl.

| | |
|---|---|
| ***B05D 1/32*** | (2006.01) |
| ***B05D 5/06*** | (2006.01) |
| ***G04B 19/10*** | (2006.01) |
| ***G04B 37/22*** | (2006.01) |

(52) U.S. Cl.

CPC ..... *B05D 1/322* (2013.01); *B05D 5/06* (2013.01); *G04B 19/10* (2013.01); *G04B 37/22* (2013.01)

(58) Field of Classification Search

CPC ..... B05D 1/322; B05D 5/06; G04B 19/10; G04B 37/22

See application file for complete search history.

(56) References Cited

U.S. PATENT DOCUMENTS

2007/0227893 A1 10/2007 Saucy
2009/0071837 A1* 3/2009 Fredenberg ..... H05K 3/07 205/640
2011/0103199 A1 5/2011 Winkler et al.
(Continued)

FOREIGN PATENT DOCUMENTS

CN 101360849 A 2/2009
CN 2 380 864 A1 10/2011
(Continued)

OTHER PUBLICATIONS

Korean Office Action dated Jul. 16, 2021 in Korean Patent Application No. 10-2020-0066656 (with English translation), 10 pages
(Continued)

*Primary Examiner* — James M Mellott
(74) *Attorney, Agent, or Firm* — Oblon, McClelland, Maier & Neustadt, L.L.P.

(57) ABSTRACT

A method for decorating the surface of a mechanical part including structuring, on the surface to be decorated, a masking layer having a thickness that is at least equal to the thickness of the decoration element to be produced; making, in the masking layer, at least one opening that coincides with the location on the surface to be decorated where the decoration element is to be produced, the opening having a contour that is identical to the contour of the decoration element and defining a volume with the mechanical part; filling the volume delimited by the masking layer and the surface to be decorated of with a filling material wherein the decoration elements are sought to be produced; and removing the masking layer.

18 Claims, 3 Drawing Sheets

(56) References Cited

U.S. PATENT DOCUMENTS

| | | | | |
|---|---|---|---|---|
| 2011/0236580 | A1* | 9/2011 | Winkler | G04D 3/0048 427/282 |
| 2013/0208577 | A1* | 8/2013 | Netuschill | C25D 5/02 205/95 |
| 2014/0112112 | A1 | 4/2014 | Plankert et al. | |
| 2016/0179001 | A1* | 6/2016 | Calame | B32B 3/30 428/609 |
| 2019/0302697 | A1* | 10/2019 | Larriere | C23C 14/5873 |

FOREIGN PATENT DOCUMENTS

| | | | |
|---|---|---|---|
| CN | 102265226 | A | 11/2011 |
| CN | 103253067 | A | 8/2013 |
| CN | 105708061 | A | 6/2016 |
| CN | 105711326 | A | 6/2016 |
| CN | 105974767 | A | 9/2016 |
| CN | 109786225 | A | 5/2019 |
| DE | 1 191 592 | | 4/1965 |
| EP | 2 138 323 | A1 | 12/2009 |
| EP | 2 725 000 | A1 | 4/2014 |
| EP | 3 336 614 | A1 | 6/2018 |
| EP | 3 575 447 | A1 | 12/2019 |
| JP | 2007-86027 | A | 4/2007 |
| JP | 2012-502813 | A | 2/2012 |
| JP | 2012-512385 | A | 5/2012 |
| JP | 2014-159645 | A | 9/2014 |
| JP | 2016-138876 | A | 8/2016 |

OTHER PUBLICATIONS

Japanese Office Action dated Jul. 13, 2021 in Japanese Patent Application No. 2020-083729 (with English translation), 5 pages.

European Search Report dated Feb. 18, 2020 in European Application 191938786 filed Aug. 27, 2019 (with English Translation of Categories of Cited Documents), 5 pages Chinese Office Action issued in Chinese Patent Application No. 2020105046100 dated Mar. 31, 2023, (w/ English translation).

* cited by examiner

METHOD FOR DECORATING A MECHANICAL PART

CROSS-REFERENCE TO RELATED APPLICATION

This application claims priority to European Patent Application No. 19193878.6 filed on Aug. 27, 2019, the entire disclosure of which is hereby incorporated herein by reference.

TECHNICAL FIELD OF THE INVENTION

The present invention relates to a method for decorating a mechanical part. More specifically, the invention relates to a method for decorating a mechanical part used in the horological or jewelry field.

BACKGROUND OF THE INVENTION

Numerous methods for producing raised decorations on a surface of a mechanical part such as a watch dial or a bezel are known in the prior art.

A certain number of these known methods consist of manufacturing the decoration elements separately from the mechanical part to be decorated, then of fastening these decoration elements to the mechanical part for which they are intended.

Another method for decorating a mechanical part such as a dial is known from the European patent application EP 2 370 865 A1 filed by The Swatch Group Research and Development Ltd. This decoration method consists of:

- taking the mechanical part to be decorated;
- making a mask of the plate type, the thickness thereof being at least equal to the desired thickness of the decoration elements, and in which openings are machined, the contours thereof corresponding to the shape of the desired decoration elements;
- positioning the mask on the surface to be decorated of the mechanical part such that the openings of the mask coincide with the locations of the mechanical part intended to receive the decoration elements;
- the mask whose thickness corresponds at least to the desired thickness of the decoration elements forms, with the mechanical part to be decorated, moulds which will be filled with a filling material; and
- removing the mask to reveal the decoration elements on the surface of the decorated mechanical part.

One advantage of this decoration method resides in the relative simplicity of implementation thereof. More specifically, whereas in the case of numerous decoration methods, the decoration elements are produced separately from the mechanical part to be decorated, then merely fastened to this mechanical part, in the case in which a mask is used, the decoration elements are directly produced and fastened to the mechanical part to be decorated in the same step of the method, which saves time.

One drawback of the decoration method using masks placed on the surface of the mechanical part to be decorated can nonetheless be seen in the fact that the risk of the mask not being in close contact with the surface of the mechanical part to be decorated cannot be ruled out, and that when filling the different moulds, there is a risk of the filling material leaking a little on the surface of the mechanical part, which requires some of these mechanical parts to be discarded. This is in particular problematic when looking to decorate dials for timepieces, since such dials are expensive mechanical parts.

SUMMARY OF THE INVENTION

The purpose of the present invention is to overcome the aforementioned problems as well as others by proposing a method for decorating mechanical parts such as a watch dial or a bezel which in particular prevents the decoration elements fixed to the surface of the mechanical part to be decorated from having smears that must be eliminated, or which even lead to the discarding of some of these mechanical parts.

For this purpose, the present invention relates to a method for decorating at least one surface of a mechanical part comprising the following steps of:

- taking the mechanical part to be decorated, on which at least one decoration element is sought to be produced according to a determined thickness and contour;
- structuring, on the surface to be decorated of the mechanical part, a masking layer having a thickness that is at least equal to the thickness of the decoration element to be produced;
- making, in the masking layer, at least one opening that coincides with the location on the surface of the mechanical part where the decoration element is to be produced, the opening having a contour that is identical to the contour of the decoration element to be produced and defining a volume with the mechanical part to be decorated;
- filling the volume delimited by the masking layer and the surface to be decorated of the mechanical part by means of a filling material in which the decoration elements are sought to be produced;
- removing the masking layer.

Thanks to these features, the present invention provides a method for decorating a mechanical part such as a dial or a bezel of a timepiece wherein the masking layer is directly formed on the surface of the mechanical part to be decorated. The masking layer is thus guaranteed to be in close contact with the surface of the mechanical part to be decorated, preventing any risk of running of the filling material in which the decoration elements are to be produced between the masking layer and the surface of the mechanical part to be decorated, which allows decoration elements defined with high precision to be obtained. In particular, the shape and the thickness of the decoration elements are meticulously adjusted. Moreover, the formation of a sacrificial mask directly on the surface of the object to be structured is simpler, faster and less costly than machining a mask separately from the mechanical part to be decorated, then positioning and pressing this mask on the mechanical part. Similarly, once the cavities have been filled with the material in which the decoration elements are sought to be produced, the operations for finishing the top surface of the decoration elements are seen to be easier to carry out in the presence of the masking layer compared to with a mask fixed to the surface of the mechanical part to be decorated which must be mechanically held in place. The decoration elements thus produced are also seen to adhere very well to the surface of the mechanical part to be decorated. Moreover, this strength of adhesion is further improved when cavities are machined in the surface of the mechanical part to be decorated in the locations that must receive the decoration elements. More specifically, thanks to the presence of the cavities, the decoration elements are anchored deep within the mechanical part to be decorated and the risks of same becoming detached from this mechanical part are very low.

According to specific embodiments, the method for decorating a mechanical part according to the invention is characterised in that it comprises the following steps:

- the filling material is a crystalline metal or an amorphous metal;
- the amorphous metal is an amorphous platinum alloy, or an amorphous palladium alloy, or an amorphous zirconium alloy;
- etching, through the opening made in the masking layer, a cavity in the surface to be decorated of the mechanical part;
- the opening in the masking layer and the cavity in the mechanical part to be decorated are etched simultaneously using a laser beam;
- the depth of the cavity etched in the surface to be decorated of the mechanical part is substantially equal to 200 μm;
- the cavity etched in the surface to be decorated of the mechanical part comprises means for anchoring the filling material;
- the cavity is delimited by at least one wall which, relative to a vertical plane perpendicular to the surface to be decorated of the mechanical part, progressively deviates from this vertical plane as it moves away from said surface to be decorated of the mechanical part;
- boring at least one conical hole which opens out into the cavity via a rear surface opposite the surface to be decorated of the mechanical part;
- depositing a bonding layer on the surface to be decorated of the mechanical part before depositing the masking layer;
- the bonding layer is formed by a layer of chromium (Cr) whereon a layer of gold (Au) is deposited;
- the layer of chromium and the layer of gold each have a thickness that is substantially equal to 50 nm;
- the masking layer is made on the surface to be decorated of the mechanical part by galvanic growth;
- the masking layer is metallic or polymeric;
- the masking layer is made of silver (Ag) or copper (Cu);
- the thickness of the masking layer is at least equal to 400 μm;
- before filling the volume delimited by the masking layer and the surface to be decorated of the mechanical part, levelling the masking layer to obtain a planar surface parallel to the surface to be decorated of the mechanical part;
- after filling the volume delimited by the masking layer and the surface to be decorated of the mechanical part and of the underlying cavity using the filling material, machining and finishing the surface to be decorated of the masking layer and of the filling material;
- after machining and finishing, the residual thickness of the masking layer and of the filling material is equal to about 200 μm;
- after machining and finishing, the masking layer is removed;
- the masking layer is removed by etching in a chemical bath;
- the filling material is glossed or polished.

BRIEF DESCRIPTION OF THE FIGURES

Other features and advantages of the present invention will appear more clearly upon reading the following detailed description of one example embodiment of the method according to the invention, said example being provided for illustrative purposes only and not intended to limit the scope of the invention, with reference to the accompanying drawing, wherein.

DETAILED DESCRIPTION OF ONE EMBODIMENT OF THE INVENTION

Figure 1:
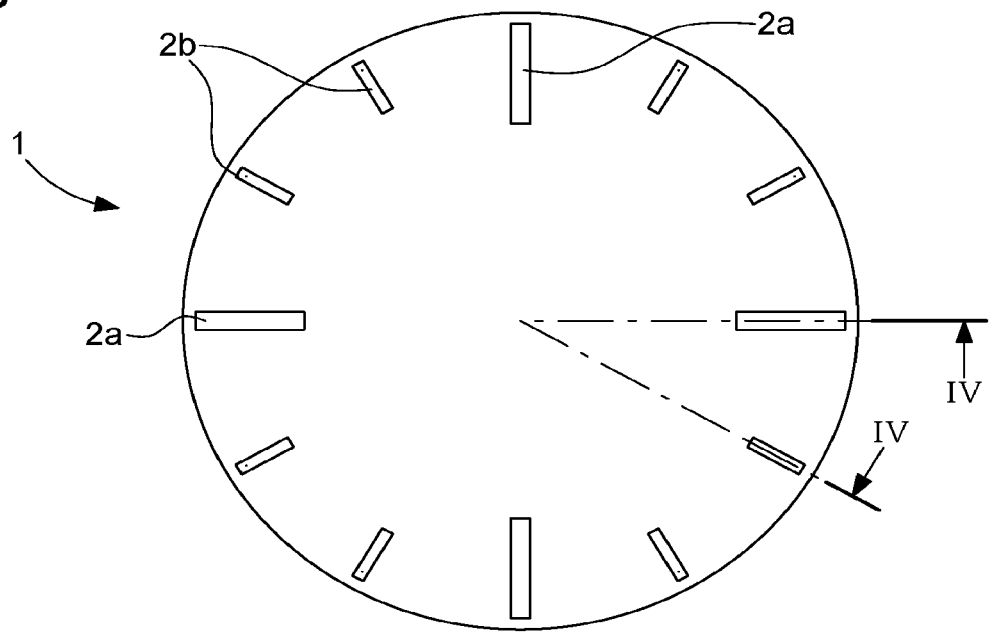
FIG. 1 is a top view of a watch dial decorated in accordance with the method of the invention.

The present invention was drawn from the general inventive idea consisting of forming decoration elements on a surface of a mechanical part to be decorated, in particular watch dials and more generally external elements of timepieces such as bezels, middle parts or even bracelet links, in addition to jewelry. In order to achieve this result, the present invention discloses the deposition, directly on the surface to be decorated of the mechanical part, of a mask of the sacrificial type, that is to say a mask that is intended to be removed at the end of the operations for decorating the mechanical part. Once the mask has been deposited in close contact with the surface of the mechanical part to be decorated, then structured so as to create openings therein which will be filled with the material in which the decoration elements are to be produced, the surface formed by the top of the mask and the decoration elements undergoes machining and potentially dressing, after which the mask is removed, conventionally by etching in a chemical bath.

In accordance with the invention, a mechanical part to be decorated is firstly taken. In the example shown in the drawing, this mechanical part to be decorated is a watch dial 1. It goes without saying that this example is provided for illustrative purposes only and in no way limits the scope of the invention, where the mechanical part to be decorated is capable of being of any type, such as an external element for a timepiece (bezel, bracelet link, middle part, etc.), a bridge, a plate, an oscillating weight or even a jewelry item. The only restriction to which this mechanical part sought to be decorated is subject is that it must be made of a material having mechanical properties that are not modified in the temperature range implemented by the method of the invention. In other words, the mechanical part must not be deformed, softened or melted during the decoration operations according to the invention.

As per the invention, the watch dial 1 is intended to be fitted with at least one decoration element, whose dimensions and thickness depend on the needs. By way of example, in the case where the mechanical part to be decorated is a watch dial 1, the decoration elements can be used to form the hour symbols: as shown in FIG. 1, four first decoration elements 2*a* of a first dimension can, for example, be used to denote midday, three o'clock, six o'clock and nine o'clock on the watch dial 1, whereas eight second decoration elements 2*b* of a second dimension can be used to denote the other full hours and complete the hour revolution.

Figure 2:
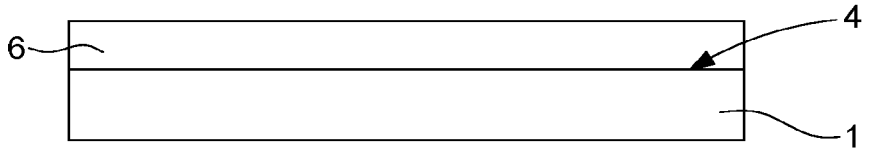
FIG. 2 is an elevation view of a watch dial on a surface to be decorated of which a masking layer has been deposited.

Once equipped with the watch dial 1, a masking layer 6 intended to form a mask of the sacrificial type is deposited on a surface to be decorated 4 of this watch dial 1, typically the top surface of this watch dial 1 (see FIG. 2). The term "sacrificial" is understood herein to refer to a masking layer which is removed after having fulfilled its purpose. This masking layer 6 will have a thickness that depends on the desired height by which the decoration elements 2*a*, 2*b* will ultimately project above the surface to be decorated 4 of the watch dial 1 once the machining operations have been carried out. For the purposes of illustration only, the thickness of the masking layer 6 is determined to be 400 μm. This masking layer 6 is deposited on the watch dial 1 by any suitable technique such as galvanic growth.

Figure 3:
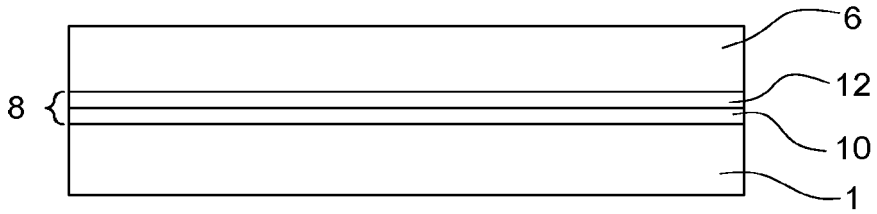
FIG. 3 is an elevation view of the watch dial in FIG. 2 with the insertion of a bonding layer between the surface to be decorated of the watch dial and the masking layer.

By way of a preferred example only, the masking layer 6 can be formed by a polymer layer or a metal layer. In the case where the masking layer 6 is metallic, it can in particular be made of silver, copper or even nickel. It should be noted that, according to one preferred embodiment of the invention, before depositing the masking layer 6, a bonding layer 8 is deposited on the surface to be decorated 4 of the watch dial 1 in order to optimise the adhesion of the masking layer 6 (see FIG. 3). Preferentially, this bonding layer 8 is formed by a layer of chromium 10 whereon a layer of gold 12 is deposited. A series of tests has determined that a thickness of about 50 nm for each of the layers of chromium 10 and gold 12 provided excellent results as regards the strength of adhesion of the masking layer 6 on the watch dial 1. The bonding layer 8 is also preferentially deposited by galvanic growth.

Figure 4:
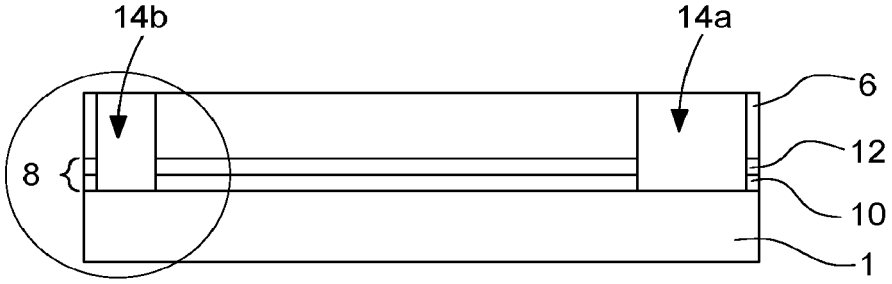
FIG. 4 is an elevation and sectional view of the watch dial according to line IV-IV in FIG. 1, wherein openings have been made in the masking layer and the bonding layer at the locations at which the decoration elements are to be produced.

Once the bonding layer 8 and the masking layer 6 have been deposited after one another on the surface to be decorated 4 of the watch dial 1, at least one opening is made in the masking layer 6 and the bonding layer 8, at the location that coincides with the position on the surface to be decorated 4 of the watch dial 1 in which the decoration element is to be produced (see FIG. 4), and whose contour and height correspond to the shape and to the dimensions of the desired decoration elements. In the case described here, there are twelve such openings, four openings 14*a* corresponding to the first four decoration elements 2*a* used to denote midday, three o'clock, six o'clock and nine o'clock on the watch dial 1, and eight openings 14*b* corresponding to the decoration elements 2*b* used to denote the other full hours and complete the hour revolution on the watch dial 1. The twelve openings 14*a*, 14*b* can be considered to have the same shape, for example square or rectangular, but the dimensions of the four openings 14*a* can be considered to be larger than those of the eight openings 14*b*. These twelve openings 14*a*, 14*b* are cut into the masking layer 6 and the bonding layer 8 by any suitable means such as a laser beam.

Figure 5:
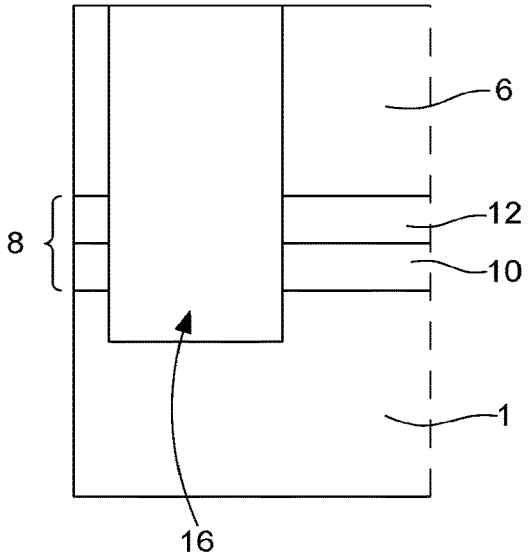
FIG. 5 is a view at a larger scale of the encircled region in FIG. 4, wherein a cavity has been etched in the surface to be decorated of the watch dial to improve the anchoring of the decoration elements.

According to one preferred but non-limiting embodiment of the invention, cavities 16 are etched in the surface to be decorated 4 of the watch dial 1, through the openings 14*a*, 14*b* made in the masking layer 6 and the bonding layer 8 (see FIG. 5). These cavities 16, which are preferably machined at the same time as the openings 14*a*, 14*b*, are intended to improve the immobilisation of the decoration elements 2*a*, 2*b* on the surface to be decorated 4 of the watch dial 1. For the purposes of illustration only, the depth of these cavities 16 is selected to be equal to about 200 μm.

Figure 6:
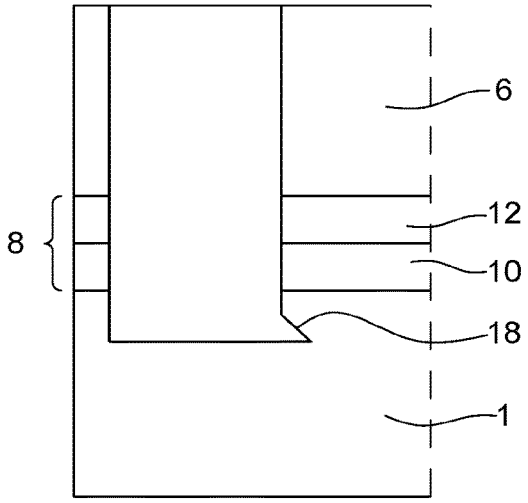
FIG. 6 is a similar view to that of FIG. 5, wherein the cavity has an inclined inner wall to improve the anchoring of the decoration elements.

In order to further improve the immobilisation of the decoration elements 2*a*, 2*b*, the cavities 16 are provided with anchoring means. According to a first embodiment of the invention (see FIG. 6), these anchoring means are formed by at least one face 18 of the wall 20 of the cavity 16 which, relative to a vertical plane P perpendicular to the surface to be decorated 4 of the watch dial 1, progressively deviates from this vertical plane P as it moves away from said surface to be decorated 4 of the watch dial 1. Thanks to the presence of this inclined face 18, it is understood that once the cavities 16 have been filled with the filling material, the resulting decoration elements 2*a*, 2*b* can no longer be dislodged from the cavities 16 and are thus permanently anchored to the watch dial 1.

Figure 7:
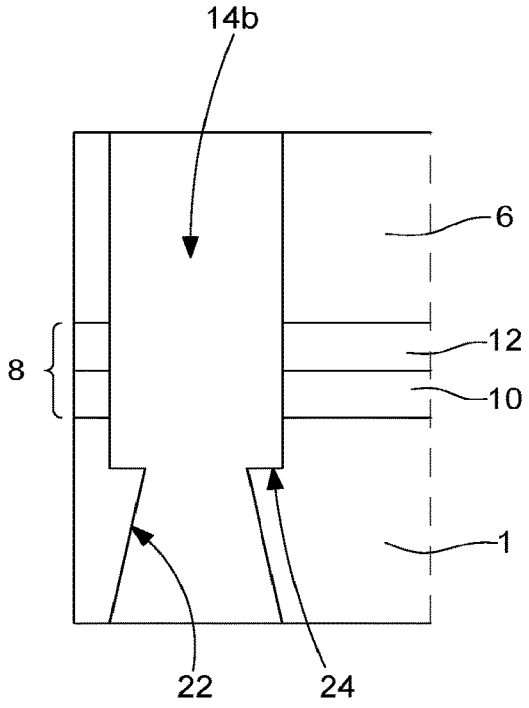
FIG. 7 is a similar view to that of FIG. 5, wherein a conical hole bored in the watch dial and opening out into the bottom of the cavity is intended to improve the anchoring of the decoration element.

Another embodiment of the invention which also aims to improve the anchoring of the decoration elements 2*a*, 2*b* on the surface to be decorated 4 of the watch dial 1 provides for boring at least one conical hole 22 in the bottom 24 of the cavities 16, these conical holes 22 flaring out towards the rear surface 26 of the watch dial 1, opposite the surface to be decorated 4 (see FIG. 7). It is also understood in this case that once the cavities 16 and the conical holes 22 have been filled with the filling material, the decoration elements 2*a*, 2*b* can no longer be dislodged.

Figure 8:
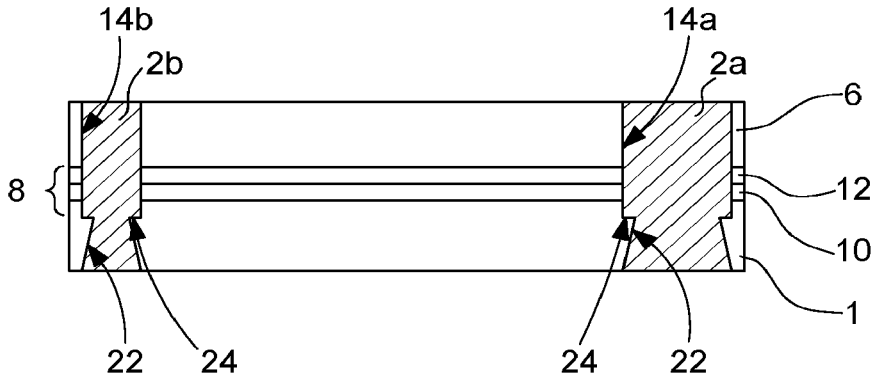
FIG. 8 is an elevation view of the watch dial on which the openings and the cavities are shown to have been filled with a filling material.

Once the openings 14*a*, 14*b* have been cut, and the cavities 16 potentially etched, they are filled with a filling material (FIG. 8). Depending on the case, the filling material can be a crystalline metal or an amorphous metal. In the case of a filling material of the amorphous metal type, an amorphous platinum alloy, or an amorphous palladium alloy, or an amorphous zirconium alloy is preferably used.

According to a first embodiment of the invention, the filling of the openings 14*a*, 14*b* and of the cavities 16 is carried out by hot working, which is a technique that consists of adjusting the viscosity of the filling material used to allow the openings 14*a*, 14*b* and the cavities 16 to be completely filled, as well as to allow the decoration elements 2*a*, 2*b* to be manufactured homogeneously and with precision.

The production of the decoration elements 2*a*, 2*b* by hot working requires the use of a material such as a metal or metal alloy, precious or otherwise, preferably rendered amorphous. More specifically, a metal or metal alloy, whose structure is amorphous, is known to be subject to, during the cooling and solidification thereof, lesser shrinkage phenomena than a metal having a crystalline structure. It is thus understood that, for the purposes of the invention, the use of a material having an amorphous structure is of particular interest. For this purpose, the material selected to produce the decoration elements 2*a*, 2*b* is brought to liquid state at a temperature that exceeds the melting temperature thereof, and is then cooled very quickly to prevent the atoms from reorganising into a crystalline structure.

During the manufacture of the amorphous material, it is preferentially shaped according to the needs. Since, in the example described here, the decoration elements 2*a*, 2*b* are intended to form the hour symbols, these decoration elements 2*a*, 2*b* will, in a large number of cases, be arranged in an annular fashion on the watch dial 1. It can thus be advantageous to give the amorphous material an annular shape with a width and a thickness that suit the dimensions of the openings 14*a*, 14*b* to be filled.

The watch dial 1, covered in the masking layer 6, is subsequently placed in a hot press and the ring of amorphous material is arranged above the watch dial 1, in line with the openings 14*a*, 14*b* to be filled. The assembly is then heated to a temperature that lies in the range between the glass transition temperature Tg and the crystallisation temperature Tx of the amorphous material. In this temperature interval, the viscosity of the amorphous material increases substantially without losing the amorphous structure thereof. The ring of amorphous material thus becomes easier to shape, such that it can be pressed against the openings 14*a*, 14*b* and take on the geometrical configuration thereof. Once the openings 14*a*, 14*b* have been filled, the amorphous material is cooled quickly enough to preserve the amorphous state thereof.

According to a second embodiment of the invention, the openings 14*a*, 14*b* made in the masking layer 6 are filled by electro-plating. This technique is used in the event that decoration elements 2*a*, 2*b* made of a crystalline metal are sought to be produced. For this purpose, a bath is used in which relevant metal ions and salts are dispersed. The watch dial 1 to be decorated, which is electrically conductive, is connected to an electrode, then immersed in the bath. Using an auxiliary electrode, an electric current is passed through the bath under the effect of which metal ions migrate to the conductive parts of the watch dial 1 in order to form the decoration elements 2*a*, 2*b*.

According to a third embodiment of the invention, the decoration elements 2*a*, 2*b* are made by injecting a metal. The watch dial 1, covered by the masking layer 6, is placed in an injection machine capable of filling the cavities 16*a*, 16*b* with liquid metal in order to create the decoration elements 2*a*, 2*b*. In a preferential manner, the metal used is brought to a temperature that is at least greater than the glass transition temperature Tg thereof, and is cooled quickly enough to prevent the atoms thereof from reorganising into a crystalline structure.

It should be noted that, before filling the volume delimited by the masking layer 6 and the surface to be decorated 4 of the watch dial 1, the masking layer 6 can be levelled to obtain a planar surface parallel to the surface to be decorated 4 of the watch dial 1.

Figure 9:
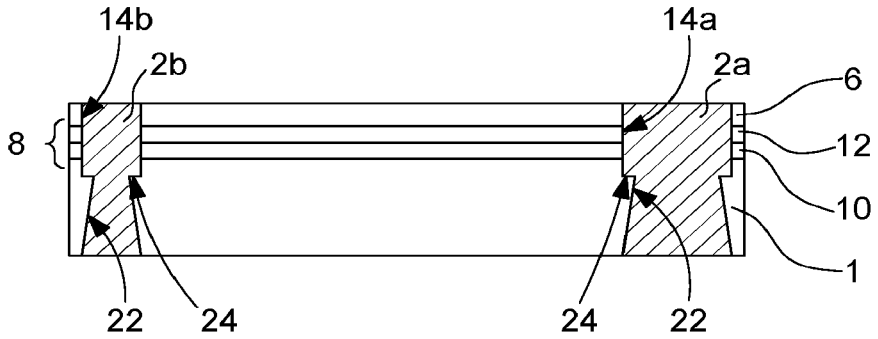
FIG. 9 is an elevation view of the watch dial on which the thickness of the masking layer and of the decoration elements is seen to have been reduced by half during finishing operations carried out on the top surface of the decoration elements.

As already stipulated above, the thickness of the masking layer 6 can be determined to be 400 μm for example. At this stage of the invention, the thickness of the decoration elements 2*a*, 2*b* is thus equal to about 400 μm. If the thickness of the decoration elements 2*a*, 2*b* is ultimately desired to be 200 μm above the surface to be decorated 4, this means that excess filling material about 200 μm thick is provided in order to machine the decoration elements 2*a*, 2*b* and perfect the surface finish thereof, in particular by glossing or polishing same (see FIG. 9).

Figure 10:
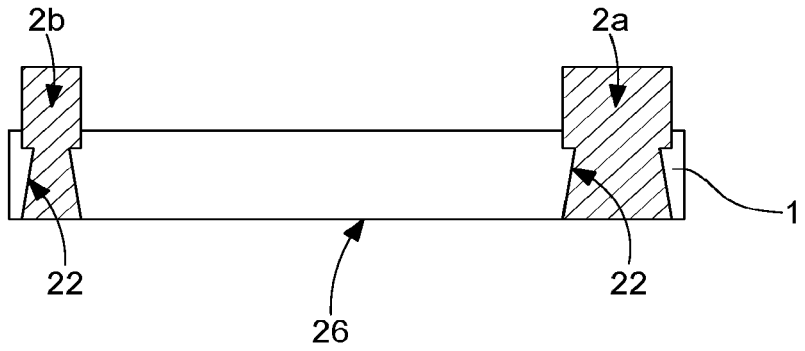
FIG. 10 is an elevation view of the watch dial on which the masking layer and the bonding layers have been removed.

Once the finishing operations for the decoration elements 2*a*, 2*b* are complete, the masking layer 6 is removed, typically by etching in a chemical bath, and the decoration elements 2*a*, 2*b* are revealed in full (see FIG. 10).

It goes without saying that the present invention is not limited to the embodiment described above and that various simple alternatives and modifications can be considered by a person skilled in the art without leaving the scope of the invention as defined by the accompanying claims.

NOMENCLATURE

1. Watch dial
2*a*, 2*b*. Decoration elements
4. Surface to be decorated
6. Masking layer
8. Bonding layer
10. Layer of chromium
12. Layer of gold
14*a*, 14*b*. Openings
16. Cavities
18. Face
20. Wall
22. Conical hole
24. Bottom
26. Rear surface

The invention claimed is:

1. A method for decorating at least one surface to be decorated of a mechanical part comprising:

taking the mechanical part to be decorated, on which at least one decoration element is sought to be produced according to a determined thickness and contour;

depositing, on the surface to be decorated of the mechanical part, a masking layer having a thickness that is at least equal to the thickness of the decoration element to be produced;

making, in the masking layer, an opening that coincides with the location on the surface to be decorated of the mechanical part where the decoration element is to be produced, the opening having a contour that is identical to the contour of the decoration element to be produced and defining a volume with the mechanical part to be decorated;

etching, through the opening made in the masking layer, a cavity in the surface to be decorated of the mechanical part, a geometry of a bottom of the cavity being different than a geometry of a top of the cavity at the surface to be decorated of the mechanical part so as to present means for anchoring the decoration elements of the filling material;

filling the volume delimited by the masking layer and the surface to be decorated of the mechanical part and the cavity by a filling material in which the decoration elements are sought to be produced; and removing the masking layer, wherein the cavity is delimited by a first vertical wall, a second vertical wall, and a third inclined wall, the first and second vertical walls being perpendicular to the surface to be decorated of the mechanical part, the means for anchoring the decoration elements of the filling material including a face of the third inclined wall progressively deviating from a bottom end of the second vertical wall as said third inclined wall moves away from said surface to be decorated of the mechanical part such that the face of the third inclined wall is inclined with a bottom end of the face of the third inclined wall intersecting a bottom end wall of the cavity which connects the bottom end of the face of the third inclined wall and a bottom end of the first vertical wall, the bottom end wall of the cavity being spaced apart from a rear surface of the mechanical part such that the means for anchoring does not extend entirety through a thickness of the mechanical part to the rear surface of the mechanical part.

2. The decorating method according to claim 1, wherein the filling material is a crystalline metal or an amorphous metal.

3. The decorating method according to claim 2, wherein the amorphous metal is an amorphous platinum alloy, an amorphous palladium alloy, or an amorphous zirconium alloy.

4. The decorating method according to claim 1, wherein the opening in the masking layer and the cavity in the mechanical part to be decorated are etched simultaneously using a laser beam.

5. The decorating method according to claim 4, wherein a depth of the cavity etched in the surface to be decorated of the mechanical part is substantially equal to 200 μm.

6. The decorating method according to claim 1, wherein before depositing the masking layer, a bonding layer is deposited on the surface to be decorated of the mechanical part.

7. The decorating method according to claim 6, wherein the bonding layer is formed by a layer of chromium whereon a layer of gold is deposited.

8. The manufacturing method according to claim 7, wherein the layer of chromium and the layer of gold each have a thickness that is substantially equal to 50 nm.

9. The manufacturing method according to claim 6, wherein the bonding layer and the masking layer are deposited on the surface to be decorated of the mechanical part by galvanic growth.

10. The manufacturing method according to claim 9, wherein the masking layer is made of silver, copper or nickel.

11. The manufacturing method according to claim 10, wherein the thickness of the masking layer is at least equal to 400 μm.

12. The manufacturing method according to claim 1, wherein before filling the volume delimited by the masking layer and the surface to be decorated of the mechanical part, the masking layer is levelled to obtain a planar surface parallel to the surface to be decorated of the mechanical part.

13. The manufacturing method according to claim 1, wherein after filling the volume delimited by the openings made in the masking layer with the filling material, the top surface of the decoration elements is machined and finished.

14. The manufacturing method according to claim 13, wherein the decoration elements are glossed or polished.

15. The manufacturing method according to claim 13, wherein after machining and finishing, the residual thickness of the masking layer and of the decoration elements is equal to about 200 μm.

16. The manufacturing method according to claim 13, wherein after machining and finishing the decoration elements, the masking layer is removed.

17. The manufacturing method according to claim 16, wherein the masking layer is removed by etching in a chemical bath.

18. The manufacturing method according to claim 1, wherein the filling material is a liquid metal.

* * * * *